US006817118B2

(12) United States Patent
Schmeichel

(10) Patent No.: US 6,817,118 B2
(45) Date of Patent: Nov. 16, 2004

(54) SELF-ADJUSTING SNOW PLOW

(76) Inventor: Charles M. Schmeichel, P.O. Box 1395, Jamestown, ND (US) 58402

( * ) Notice: Subject to any disclaimer, the term of this patent is extended or adjusted under 35 U.S.C. 154(b) by 0 days.

(21) Appl. No.: 10/404,164

(22) Filed: Mar. 31, 2003

(65) Prior Publication Data

US 2004/0060200 A1 Apr. 1, 2004

(30) Foreign Application Priority Data

Nov. 12, 2001 (WO) ..... PCT/US01/47125

(51) Int. Cl.[7] ..... E01H 5/04
(52) U.S. Cl. ..... 37/232; 37/267; 37/266
(58) Field of Search ..... 37/232, 233, 231, 37/264, 266, 267; 172/811, 817

(56) References Cited

U.S. PATENT DOCUMENTS

| | | | | |
|---|---|---|---|---|
| 1,143,677 A | | 6/1915 | Darois | |
| 1,805,933 A | | 5/1931 | Victor | |
| 2,231,875 A | | 2/1941 | Behnke et al. | |
| 3,466,766 A | | 9/1969 | Kahlbacher | |
| 3,477,149 A | | 11/1969 | Wagner | |
| 3,545,109 A | | 12/1970 | Boschung | |
| 4,127,951 A | * | 12/1978 | Hatch | 37/231 |
| 4,357,766 A | * | 11/1982 | Croteau et al. | 37/281 |
| 4,843,744 A | * | 7/1989 | Jansen | 37/232 |
| 4,944,104 A | | 7/1990 | Kowalczyk | |
| 5,044,098 A | * | 9/1991 | Berghefer | 37/232 |
| 5,075,985 A | | 12/1991 | Mensch | |
| 5,109,618 A | * | 5/1992 | Grubler et al. | 37/232 |
| 5,136,795 A | * | 8/1992 | Rosenberg | 37/233 |
| 5,297,351 A | * | 3/1994 | Cote | 37/232 |
| 5,509,219 A | | 4/1996 | Mecca | |
| 5,560,129 A | | 10/1996 | Rothbart | |
| 5,595,007 A | * | 1/1997 | Biance | 37/268 |
| 5,724,755 A | | 3/1998 | Weagley | |
| 5,743,032 A | * | 4/1998 | Vauhkonen | 37/446 |
| 6,112,438 A | | 9/2000 | Weagley | |
| 6,202,328 B1 | * | 3/2001 | Fulton | 37/231 |
| 6,240,658 B1 | | 6/2001 | Knutson et al. | |
| 6,240,660 B1 | * | 6/2001 | Dugas | 37/280 |
| 6,618,965 B1 | * | 9/2003 | Schultz et al. | 37/232 |

FOREIGN PATENT DOCUMENTS

| | | |
|---|---|---|
| DE | 3334121 | 4/1984 |
| DE | 3319223 | 7/1984 |

* cited by examiner

*Primary Examiner*—Thomas B. Will
*Assistant Examiner*—Thomas A Beach
(74) *Attorney, Agent, or Firm*—Moore, Hansen & Sumner PLLP; Robert C. Freed

(57) ABSTRACT

A self-adjusting snow plow for use with pickup trucks and sport utility vehicles is disclosed. The snow plow includes a mounting apparatus for attachment to a vehicle and a plow blade having first and second ends, a top, a bottom, a plurality of retention members and a rubber scraper. The mounting apparatus includes a pair of mounting uprights and a hitch tongue which is easily mounted in a hitch receiver which is secured to the front of a vehicle. The retention members are constructed and arranged to at least partially encircle and slidably engage one of the respective mounting uprights and the retention members allow the respective ends of the plow blade to slide upward relative to the mounting upright most proximate to that end of the plow while the other end of the plow remains generally in the same position relative to the mounting upright proximate that end of the plow blade. The retention members also permit the bottom of the plow blade to freely pivot away from the respective mounting uprights when the plow blade is engaged with the mounting apparatus in a working orientation and the vehicle is in motion in a direction rearward of the plow blade.

32 Claims, 14 Drawing Sheets

SELF-ADJUSTING SNOW PLOW

RELATED APPLICATIONS

The present application is related to and claims priority to PCT application No. PCT/US01/47125 for SELF-ADJUSTING SNOW PLOW filed Nov. 12, 2001.

FIELD OF THE INVENTION

The present invention relates to adjustable snow plows for attachment to personal utility vehicles such as pickup trucks and sport utility vehicles.

BACKGROUND OF THE INVENTION

Moving snow off of open ground, streets, sidewalks and parking lots is an age-old problem in less temperate climates where significant snowfall is anticipated during colder periods of the year. For instance, in many parts of Canada and in many northern states in the United States, significant snowfall can be expected during the late fall and early-to-mid winter months. Snowfall in some of these areas is also possible in early spring.

Clearing freshly fallen snow from open ground, parking lots, driveways, sidewalks and roadways, whether these surfaces are paved or not, is a task common to all of these areas that is generally required to make these surfaces passable. If the snow is allowed to accumulate over a period of weeks, the snow eventually makes the use of these surfaces for pedestrian and vehicular travel difficult, if not treacherous. Therefore, many devices have been designed and manufactured to remove accumulated snow from such surfaces. Municipalities generally use large vehicles with enormous snow plows to clear paved roadways used by the public and states in these areas also generally have a fleet of these vehicles to clear snow from such roadways and from large parking lots on state-owned properties. However, the purchase and use of such a vehicle by individuals, who have a need to move accumulated snow in smaller areas, is less feasible. First of all, the larger vehicles are expensive to purchase and maintain and are, in some cases, dedicated solely to the removal of accumulated snow. It will be appreciated that it would not be cost effective for an individual to purchase, house and maintain such a vehicle for removing snow from driveways and smaller parking lots during a limited period of the year.

For this reason, many inventors have designed and manufactured adjustable snow plows that can be attached to pickup trucks and other vehicles for a period of time during the year when snow removal is required. In this way, the vehicles can be used for other purposes during periods when snow removal is not required. Many of the snow plows attached to these vehicles, however, are large and heavy and are not easily attached and removed from the vehicles. A number of snow plows have been invented that attempt to address these problems. For instance, Kowalczyk (U.S. Pat. No. 4,944,104) discloses a detachable snow plow assembly that is pivotally attached to a common passenger vehicle. In one embodiment of the invention, the snow plow includes rollers secured within channels attached to mounting uprights to allow the plow blade to ride up and down when the blade comes into contact with irregularities in the surface. The plow blade can also pivot forward along with the mounting uprights in certain embodiments when the vehicle is moving backward allowing the plow blade to pivot forward over the ground. In other disclosures, such as the snow plow assembly disclosed by Rosenberg (U.S. Pat. No. 5,136,795) a trip mechanism is disclosed which allows the lower part of the plow blade to pivot backward when the plow blade comes into contact with relatively immovable objects and the trip mechanism is actuated. Rosenberg also discloses a rubber scraper at the bottom of the plow blade which is secured between two metal plates and oriented at an angle rearward of a vertical orientation. Rubber scrapers are also disclosed on older snow plows, such as the snow plow mold board disclosed by C. H. Wagner (U.S. Pat. No. 3,477,149), which discloses a resilient scraping blade made of rubber. This is a common feature in many snow plows, allowing the rubber scraper to contact the ground and provide a somewhat more forgiving surface with which to contact the ground when the plow is used to remove accumulated snow, but the rubber scraper is generally accompanied by a metal backing.

Although each of these has its own advantages, none of them are easy to attach and remove from the vehicle once attached. They also tend to be heavy and cumbersome, and at least somewhat unsightly. The present invention provides a more cost effective and attractive snow plow for removing smaller amounts of accumulated snow from driveways and small-to-medium sized parking lots where one individual may wish to use his or her vehicle to remove snow during a relatively limited period of time, while still having use of the vehicle for other purposes not involving snow removal, when the snow plow must either be removed or placed in a suitable position for non-snow removing transit. The present invention provides solutions for these and other problems associated with the prior art devices for removing accumulated snow and methods used to accomplish the same.

SUMMARY OF THE INVENTION

The present invention provides a self-adjusting snow plow for attachment to a vehicle in such a manner to permit the snow plow to make position adjustments when, during use when the vehicle is in motion, a portion of the snow plow comes into contact with a mass of snow or other objects on the ground, upon which the vehicle travels when in motion, that are relatively immovable. The self-adjusting snow plow preferably includes a mounting apparatus for attachment to the vehicle and a plow blade. The mounting apparatus preferably includes first and second mounting uprights and the plow blade has first and second ends, a top, a bottom, a retention member and a rubber scraper preferably secured to the bottom of the plow blade. In preferred embodiments, the plow blade will include first and second retention members. In these embodiments, the retention members are constructed and arranged to at least partially encircle one of the respective mounting uprights when the plow blade is engaged with the mounting apparatus in a working orientation such that the plow blade is in contact with the ground or objects on the ground. The respective retention members are slidably engaged with the respective mounting uprights when the plow blade is engaged with the mounting apparatus in a working orientation. When the plow blade comes into contact with a mass of snow or other objects on the ground that are relatively immovable, the respective retention members can slide upward along the respective mounting uprights to enable either or both of the respective ends of the plow blade to slide upwardly relative to the mounting upright most proximate to that end of the plow blade. The retention members also permit the bottom of the plow blade to freely pivot away from the respective mounting uprights when the plow blade is engaged with the mounting apparatus in a working orientation and the vehicle is in motion in a direction rearward of the plow blade. In preferred embodiments, the rubber scraper secured to the bottom of the plow blade is a resilient elastomeric member having a resting orientation in which the rubber scraper extends downwardly and away from the bottom of the plow blade at an angle which extends forward from a plane which extends along a main surface of the plow blade. In preferred embodiments, the rubber scraper is preferably about an inch thick and extends away from the plow blade at least about three and one-half inches. In alternate embodiments having a single retention member, the retention member is alternatively constructed and arranged to either encircle or partially encircle both of the mounting uprights.

It is the primary objective of the present invention to provide a method of clearing accumulated snow from the surface of driveways, parking lots and other similar areas where snow removal is essential during the winter months.

It is an additional objective of the present invention to provide such an apparatus that can be easily mounted and removed from the front end of pickup trucks, sport utility vehicles and other commonly used vehicles.

It is a further objective of the present invention to provide such an apparatus for snow removal that is much simpler to install and use then other similar devices commonly found in the market today.

It is a further objective of the present invention to provide such an apparatus for snow removal which includes a plow blade which is relatively light and allows an individual person to lift respective ends of the plow blade in order to lower them into position for clearing snow or to lift the respective ends of the plow blade to secure the blade in position for transit.

It is a further objective of the present invention to provide such an apparatus for snow removal that does not require the owner of the vehicle to purchase separate running lights for the vehicle in order to use the self-adjusting snow plow.

It is yet another objective of the present invention to provide such an apparatus for snow removal that easily slides upward on a mounting apparatus to allow the plow blade to go up and over immovable objects encountered during use.

It is yet another objective of the present invention to provide such an apparatus for snow removal that allows the operator to drive in reverse after moving snow off of a flat surface, wherein the plow blade is hinged so that the blade "floats" freely on a pair of mounting uprights and can slide up and down independently on the mounting uprights and the lower portion of the plow blade can pivot forward with respect to the mounting uprights allowing the vehicle to easily draw the plow blade in reverse.

It is yet another objective of the present invention to provide such an apparatus for snow removal that lifts the rubber scraper at the bottom of the plow blade off the ground when the vehicle draws the plow blade in reverse and the lower portion of the plow blade pivots forward with respect to the mounting apparatus.

It is still a further objective of the present invention to provide such a method that does not employ the use of expensive and heavy hydraulic systems that are common used in such devices today.

These objectives are preferably accomplished by the use of a common hitch receiver that is attached to (and extends forward from) the front end of the vehicle that is to be used in the plowing operation. This receiver hitch preferably provides a mounting point for the mounting apparatus, which is accomplished by inserting a tongue of the plow hitch into the hitch receiver and then locking it into place with a pin. This forms a solid mounting for the present invention that allows it to be quickly and easily attached to the front end of any vehicle. A primary advantage of this invention is that it does not require that a user keep the plow assembly on the plow vehicle for the entire season. Its ease of use is also a primary advantage as is its moderate cost.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

BRIEF DESCRIPTION OF THE DRAWINGS

In the drawings, in which corresponding reference numerals and letters indicate corresponding parts of the various embodiments throughout the several views, in which the various embodiments generally differ only in the manner described and/or shown.

DETAILED DESCRIPTION OF THE PREFERRED EMBODIMENTS

Figure 1:
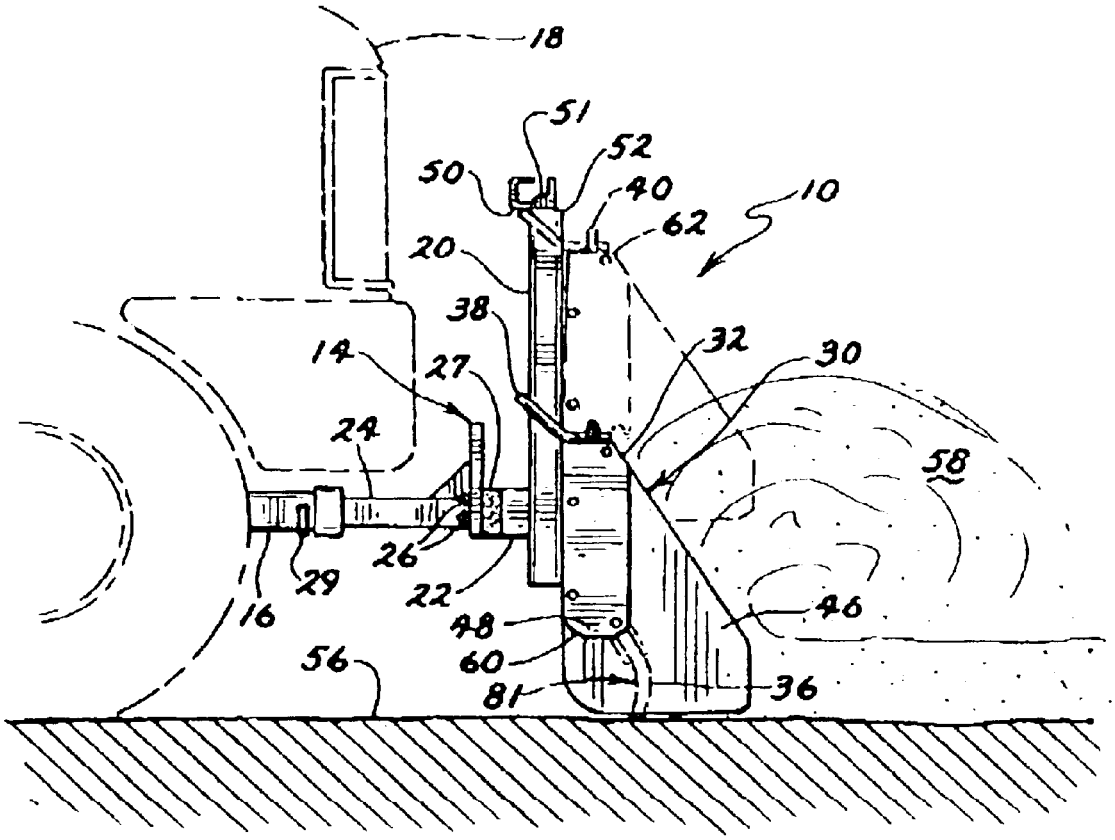
FIG. 1 is a side elevation of a preferred embodiment of the present invention showing a self-adjusting snow plow attached to a vehicle (shown in phantom). The plow blade is shown in phantom in an elevated position.
Figure 2:
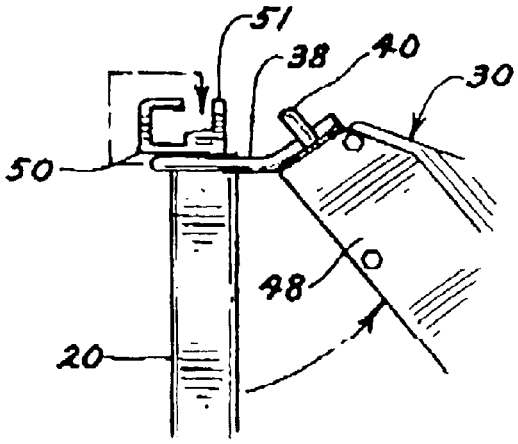
FIG. 2 is a partial side elevation of the self-adjusting snow plow shown in FIG. 1 showing the plow blade in a position in which the bottom (not shown) of the plow blade is pivoted forward so that the preferred retention member may be disengaged from the mounting upright and placed in the attachment member so that the plow blade can reside in a non-working transit orientation shown in FIG. 3.
Figure 3:
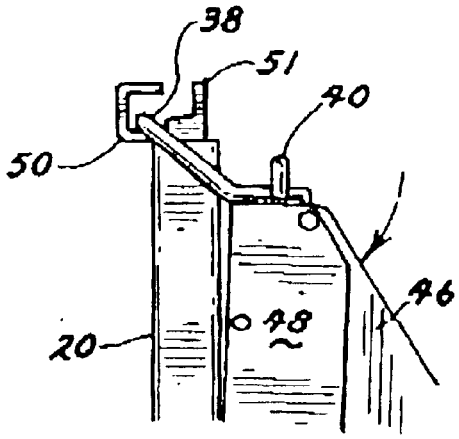
FIG. 3 is a partial side elevation of the self-adjusting snow plow shown in FIGS. 1 and 2, but showing the plow blade in the non-working transit orientation.
Figure 7:
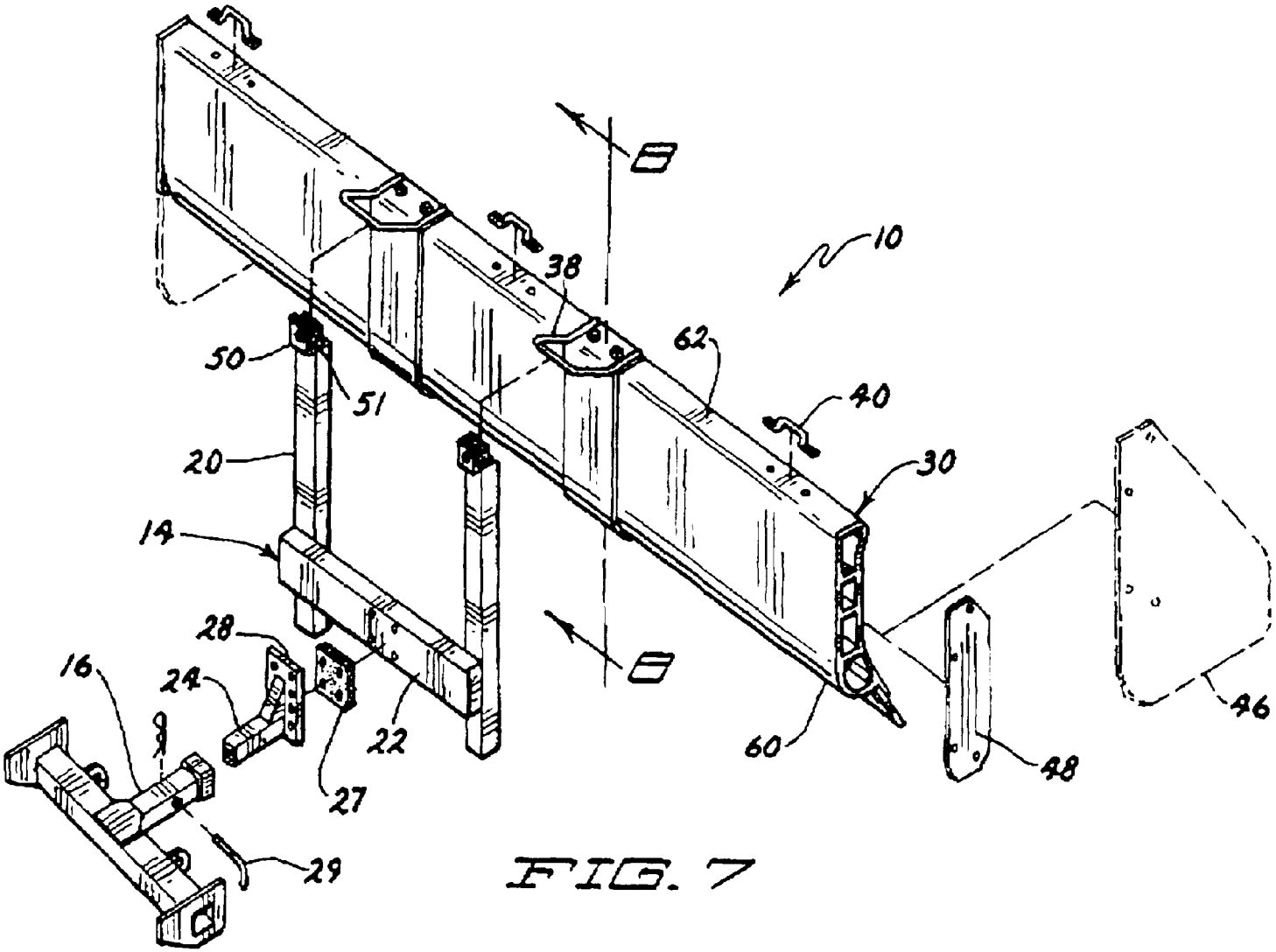
FIG. 7 is an exploded perspective view of the preferred self-adjusting snow plow shown in FIGS. 1–3.
Figure 8:
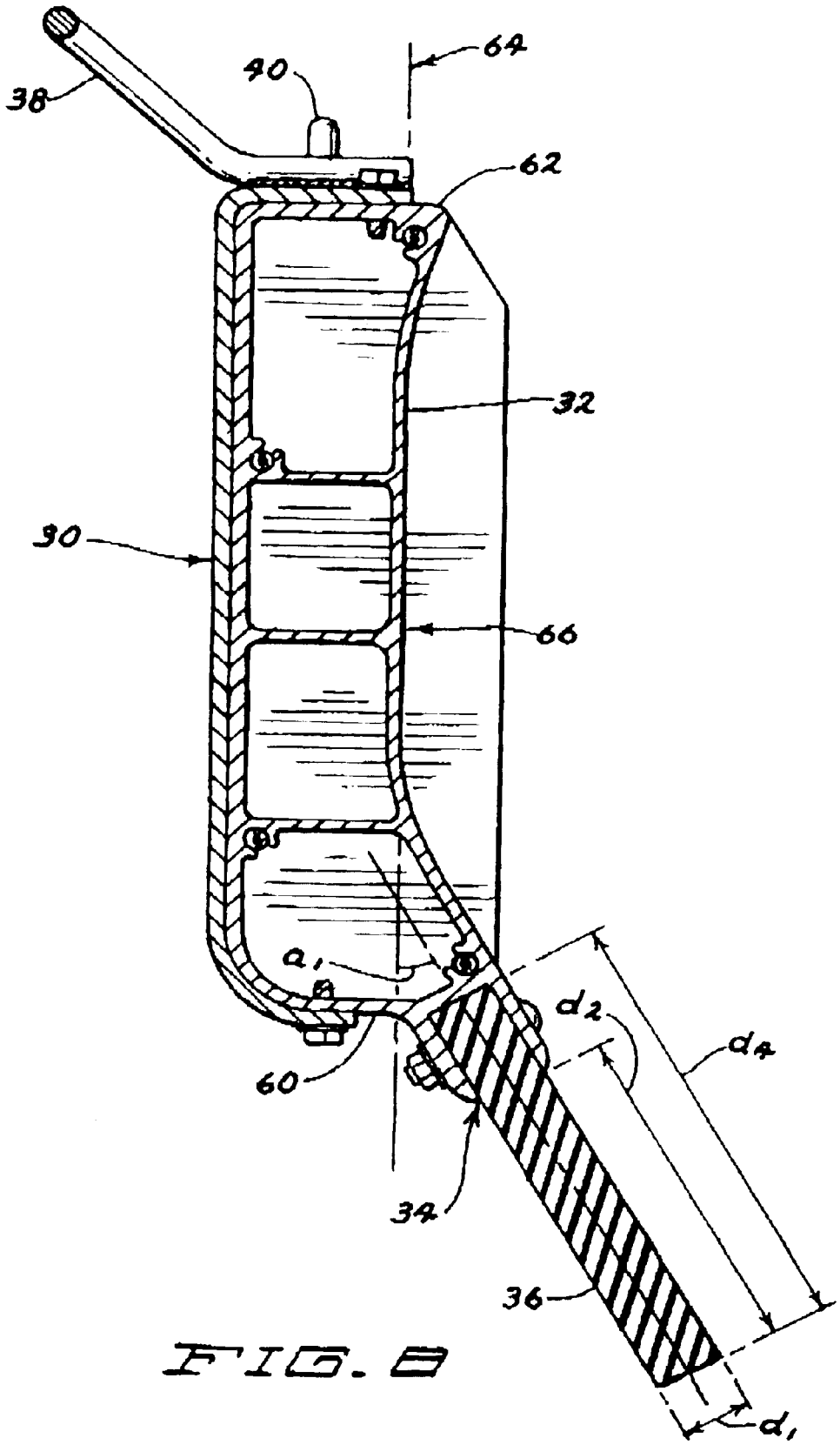
FIG. 8 is a cross-sectional view of the preferred plow blade shown in FIG. 7 as seen from the line 8—8 of FIG. 7.

Referring now to the drawings, and more particularly FIGS. 1–3, a preferred self-adjusting snow plow 10 of the present invention is shown. The preferred snow plow 10 includes a mounting apparatus 14 and a plow blade 30. Referring now also to FIGS. 7 and 8, the preferred mounting apparatus 14 includes a hitch receiver 16 which is secured to a vehicle 18 (partially shown in phantom in FIG. 1). The mounting apparatus 14 also includes two mounting uprights 20 that are interconnected by an interconnecting member 22. In this embodiment, a hitch tongue 24 is secured to the interconnecting member 22 by a series of bolts 25 secured by nuts 26. The bolts 25 secure the hitch tongue 24 to the interconnecting member 22 with a resilient rubber connecting member 27 interspersed between the interconnecting member 22 and a flat connecting plate 28 of the hitch tongue 24. A securing pin 29 secures the hitch tongue in the hitch receiver 16. The resilient rubber connecting member 27 allows the entire snow plow 10 some flexibility when the plow blade 30 is subjected to great forces. This reduces the shock and vibration in the vehicle due to impacts against relatively immovable objects.

The preferred plow blade 30 includes a mold board 32 providing a channel 34 in which a rubber scraper 36 is secured. The preferred mold board 32 is a single piece aluminum extrusion, although other materials may be used. The plow blade 30 also includes two retention members 38 and a plurality of lifting handles 40. The preferred plow blade 30 has enlarged end caps 46 secured at each end if the plow blade with blade cap securing plates 48. In preferred embodiments, the end caps 46 and the rubber scraper 36 are made of resilient elastomeric materials such as hardened natural rubbers and other synthetic materials, which have been used commercially to replace such products. In preferred embodiments, this material can be Styrene-Butadiene rubbers (SBR), butylene rubber (a copolymer of isobutylene and isoprene), Acrylonitrile-Butadiene rubbers (NBR), neoprene, Thiokol® rubbers and the like; preferably SBR. In the most preferred embodiment SBR 60 Durometer rubber is used. It will be appreciated that the term "rubber", when used to describe the various embodiments of the scraper 36 or the end cap 46, is used in a general sense and is not meant to limit the material used to construct the scraper 36 or the end cap 46 solely to rubber, but that it will also mean the aforementioned elastomers and other like materials.

Figure 4:
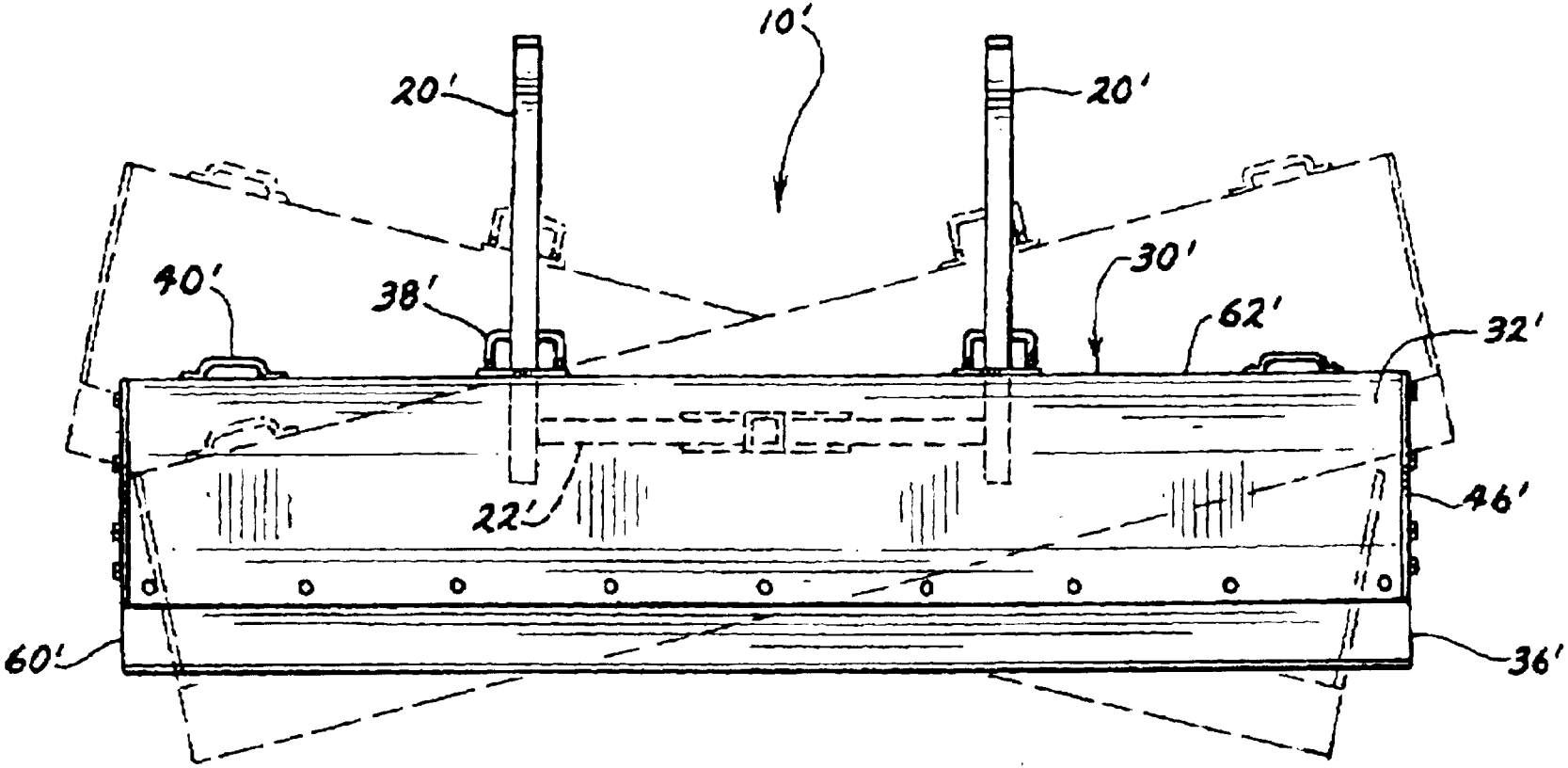
FIG. 4 is a front elevation of an alternate self-adjusting snow plow; the plow blade is shown in a working orientation and is shown in phantom in further working orientations when one end or the other is raised with respect to the mounting uprights.
Figure 5:
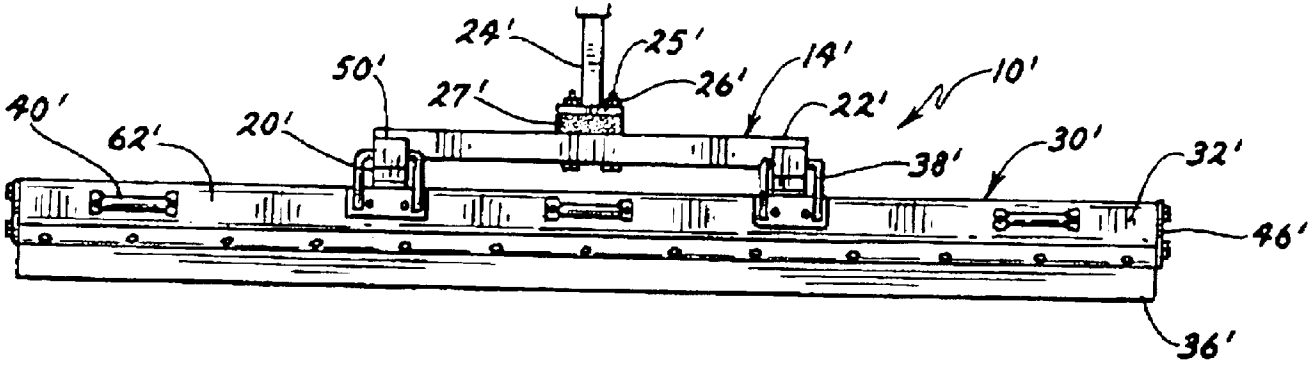
FIG. 5 is a top elevation of the self-adjusting snow plow shown in FIG. 4.

Referring now also to FIGS. 4 and 5, a further alternate embodiment of the plow blade 30' is shown in which the end caps 46' are metal sheets the size of and similar to the blade cap securing plates 48 of the previously discussed preferred embodiment. These end caps 46' do not extend beyond the bottom 60' of the mold board 32'. It will be appreciated that the embodiment shown in FIGS. 1–3, 7 and 11 can be modified by removing the end caps 46 and simply replacing them with the end cap securing plates 48, which take their place and become the replacement end caps as used in the alternate embodiments shown in FIGS. 4–5 and 8. With the exception of the different end caps 46, 46', everything else about these embodiments is generally the same.

Figure 6:
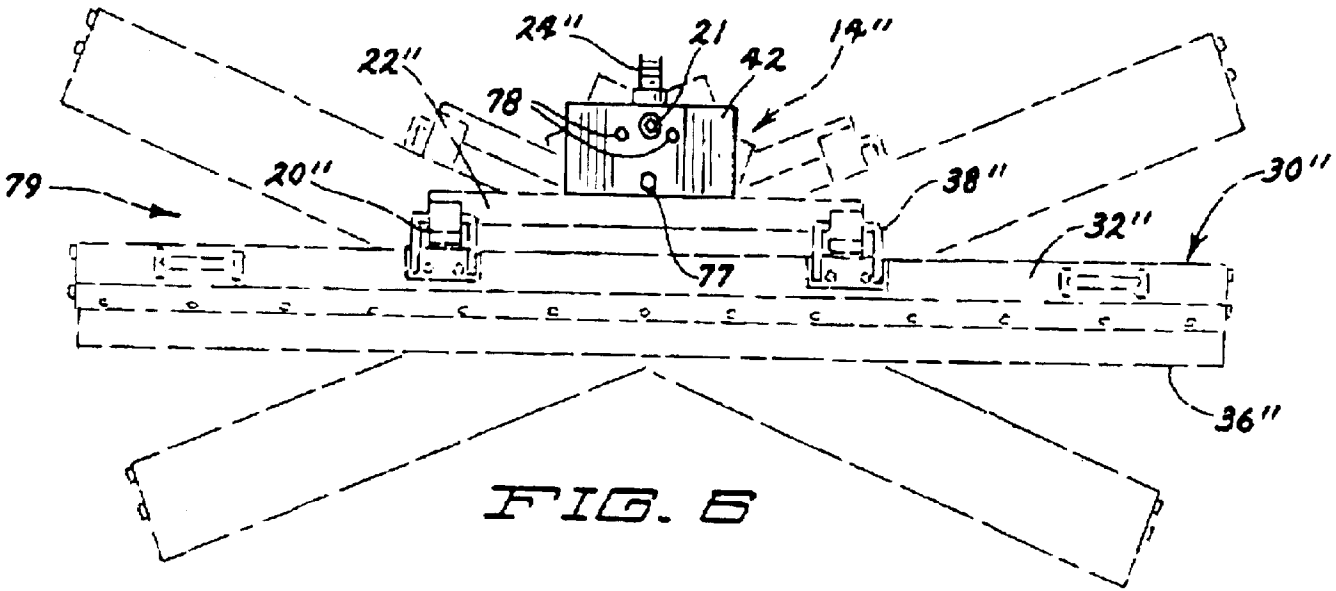
FIG. 6 is a top elevation of a further embodiment of the self-adjusting snow plow of the present invention showing a plow blade in phantom which is the same as that shown in FIG. 5, but showing an alternate mounting apparatus having a pivotal hitch assembly which can be secured to place the plow blade at an angle to a plane perpendicular to a line parallel to a forward direction of the vehicle (not shown)

Referring now also to FIG. 6, an alternate mounting apparatus 14" is shown in which the mounting uprights 20" are secured to an interconnecting member 22" which is joined to a pair of generally identical plates 42, only one of which is shown, which sandwich and are pivotally connected with the alternate hitch tongue 24" by a pivot pin 77. A removable lock pin 21 is used to secure the plates 42 in one position or another (as shown in phantom) by removing the lock pin 21 and turning the blade 30" so that holes 78 (shown only in the upper plate shown in FIG. 6) in the plates 42 and the hitch tongue 24" (not shown) will align after the mounting uprights 20" and the plow blade 30" are turned sufficiently to allow the respective lock pin receiving holes in the plates 42 and the hitch tongue 24" to be aligned. The plow blade 30' of the second embodiment shown in FIGS. 4–5 and 8 has been found to be somewhat more effective than the preferred plow blade 30 (shown in FIGS. 1–3, 7 and 11) when the plow is pivoted in either direction to push snow to one side or the other of the vehicle 18, because the larger end caps 46 of the preferred embodiment are not used. This makes it easier for snow to slide off of one end of the plow blade 30', 30" or the other when the plow blade is being pushed forward. It is possible to address this potential enhancement by simply removing the end cap 46 from one end of the preferred plow blade 30, when it is used with the alternate mounting apparatus 14", in which case the end cap 46 at the end which is tilted backwards will be the one which is removed and replaced by the end cap securing plate 48.

In FIG. 1, the preferred plow blade 30 is shown in a working orientation in which the retention members 38 encircle the mounting uprights 20. As force is applied to the plow blade 30 and the rubber scraper 36, the rubber scraper has a tendency to bend backward at its lowest extremities most removed from the mold board 32. In this way, the force on the lower part of the rubber scraper can have the effect of lifting the plow blade 30 and forcing it to slide upward along the mounting uprights until the retention member strikes the catch structure 50 at the upper end 52 of the mounting uprights 20 as shown in phantom in FIG. 1.

Figure 9:
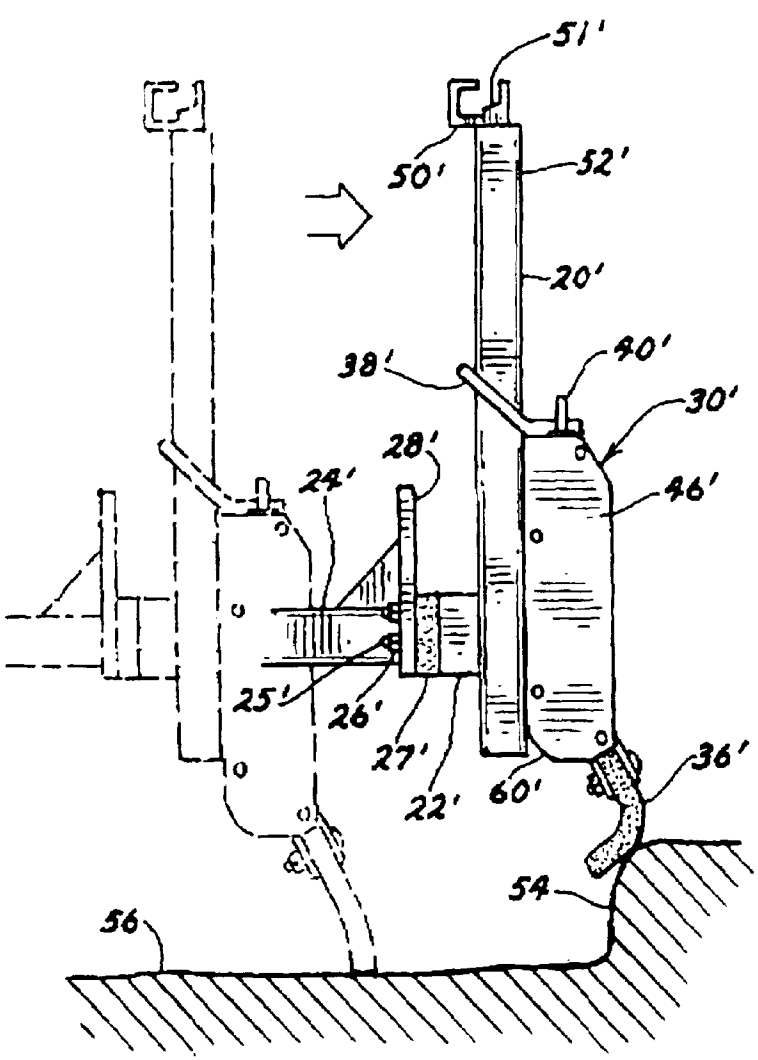
FIG. 9 is a side elevation of the alternate self-adjusting snow plow shown in FIGS. 4 and 5 illustrating how the plow blade slides upwardly with respect to the mounting uprights when it moves forward and comes into contact with a relatively immovable object on the ground, wherein the drawing illustrates in phantom the plow blade in a working orientation as it is moving forward toward such a relatively immovable object and also showing the plow blade once it has moved upward with respect to the mounting uprights after the rubber scraper has come into contact with such a relatively immovable object.

Referring now also to FIG. 9, which shows the alternate embodiment shown in FIGS. 4 and 5, it is noted that this will also occur when the rubber scraper 36' comes into contact with a relatively immovable object 54 along the ground 56 such as a curb. As shown in FIG. 1, the rubber scraper 36 will also bend backwards at the lower extremities when it is pushing a mass of accumulated snow 58.

Figure 10:
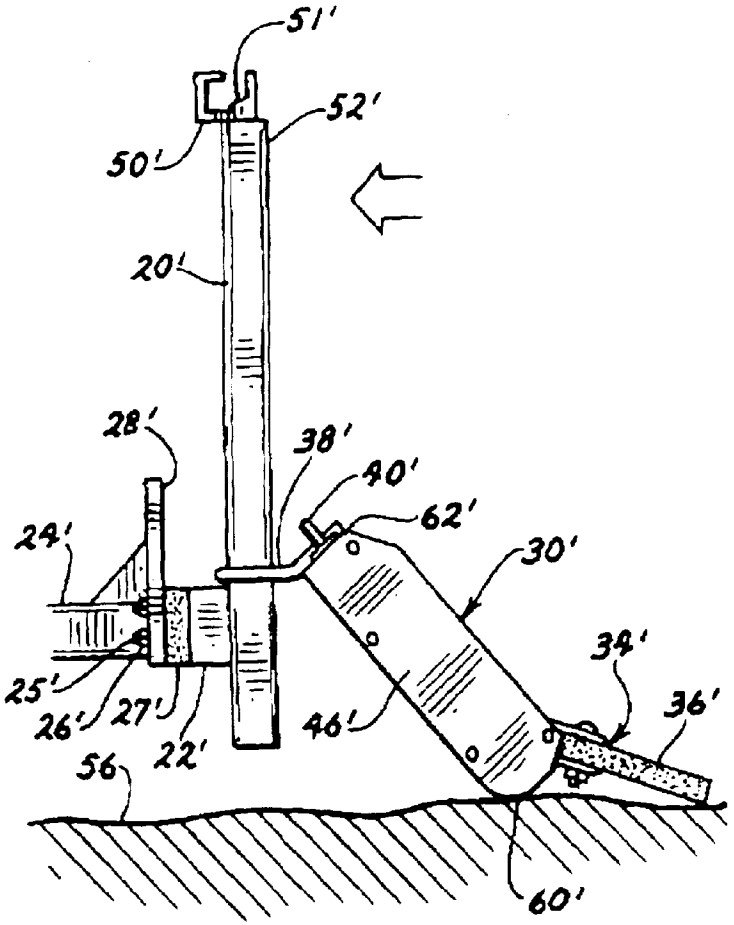
FIG. 10 is a side elevation of the alternate embodiment of the self-adjusting snow plow shown in FIGS. 4–5 and 9 showing how the bottom of the plow blade pivots outward away from the mounting uprights when the vehicle (not shown) to which the self-adjusting snow plow is attached, moves backward drawing the plow blade with the vehicle.

Referring now also to FIG. 10, when the vehicle 18 (not shown) is placed in reverse and the plow blade 30' is drawn backwards, the bottom 60 of the plow blade 30' will naturally pivot away from the mounting uprights 20' because the plow blade 30' is only secured at the top 62 by the retention members 38'.

Figure 11:
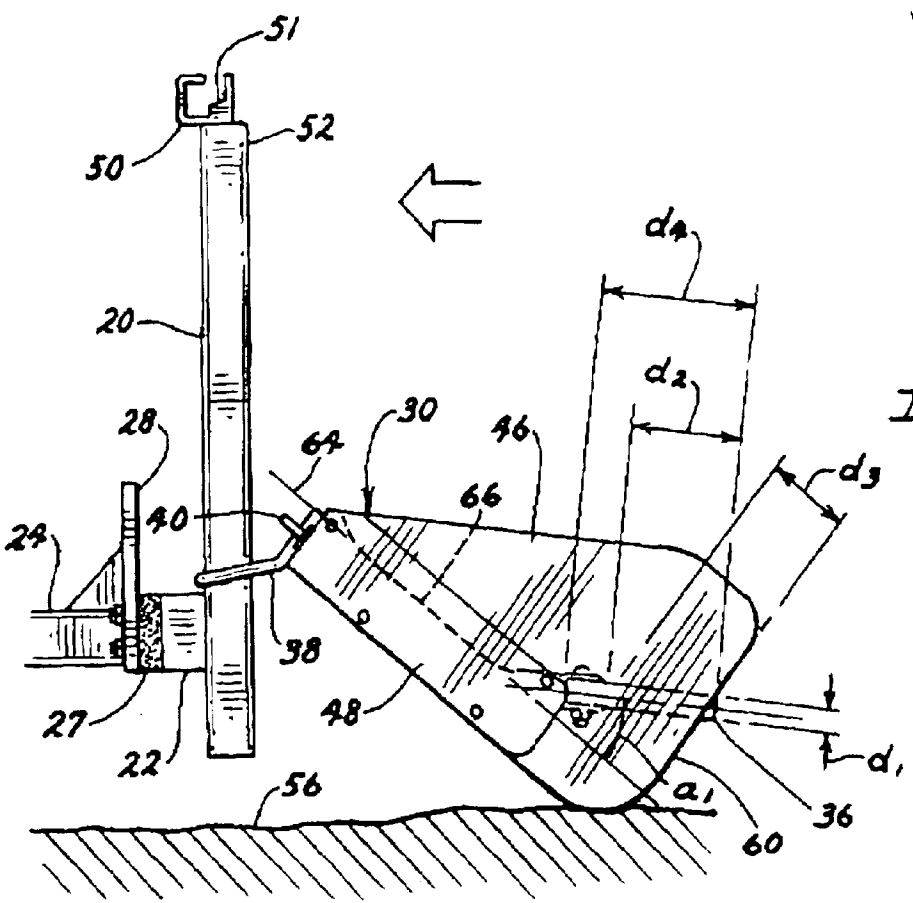
FIG. 11 is a side elevation similar to that shown in FIG. 10, but showing the preferred plow blade shown in FIGS. 1–3 when the vehicle (not shown) moves backward drawing the preferred plow blade with it in a manner which allows the bottom of the plow blade to pivot forward, away from the mounting uprights.

Referring now also to FIG. 11, in which the preferred adjustable snow plow 10 and the preferred plow blade 30 are shown, when this embodiment of the plow blade 30 is drawn backwards when the vehicle 18 (not shown) goes in reverse, the rubber scraper 36 is raised above the ground 56 because the end caps 46 extend well beyond the bottom of the mold board 32 and the channel 34 provided by the mold board 32 for the rubber scraper 36 which permits snow and gravel and debris to pass below the rubber scraper 36 when the plow blade 30 is drawn backwards. This is advantageous in certain situations in which there is a desire not to draw snow backwards with the plow blade. When using other devices, it is also necessary to lift the plow blade 30 so as to not draw snow backwards when taking the vehicle in reverse. In this case, however, the extension to the plow blade 30 provided by the end caps 46 raises the bottom of the mold board 32 and the rubber scraper 36, which extends away from the mold board 32 at an angle. Referring now also to FIG. 8, this angle, angle $a_1$, relative to a plane 64 of the main surface 66 of the plow blade 30' is at least about 10°, preferably at least about 20°, more preferably at least about 25°, even more preferably at least about 30°, even more preferably at least about 32° and most preferably at least about 32.5°. In preferred embodiments, the end caps 46 extend below the mold board 32 a distance $d_3$. In preferred embodiments, this distance is at least about two inches, preferably at least about 2.5 inches, more preferably at least about three inches, and most preferably at least about 3.5 inches, and even more preferably at least about four inches.

Referring now specifically to FIG. 8, in preferred embodiments, the rubber scraper 36, 36' is skirtboard rubber which has a thickness, $d_1$, in a range from about 0.5 to about two inches, preferably about 0.625 to about 1.75 inches and more preferably from about 0.75 inches to about 1.5 inches. In the most preferred embodiments, the thickness of the rubber scraper 36, 36' is about one inch and it is made of SBR rubber having a hardness of about 60 although it may be more or less than 60 depending on the nature of the environment in which it will be used and other considerations, including wear resistance, speed of use and the like. The length of the rubber scraper 36, 36' designated by line $d_4$ is preferably in a range from about four to about ten inches, more preferably from about five to about nine inches, even more preferably from about six to about eight inches. In the most preferred embodiments, the length of the rubber scraper 36, 36' will be about six and one-half inches. In preferred embodiments, the length, $d_2$, of the amount of the rubber scraper 36, 36' which extends beyond the bottom of the mold board 32, 32' of the plow blade 30, 30' is preferably from about three to about seven inches, more preferably from about four to about six inches, most preferably about five inches. In preferred embodiments, the length of the rubber scraper 36, 36' which extends beyond the bottom of the mold board 32, 32' is at least about two and one-half inches, preferably at least about three inches, more preferably, at least about three and one-half inches, even more preferably at least about four inches, and even more preferably, at least about four and one-half inches, most preferably at least about five inches.

Figure 12:
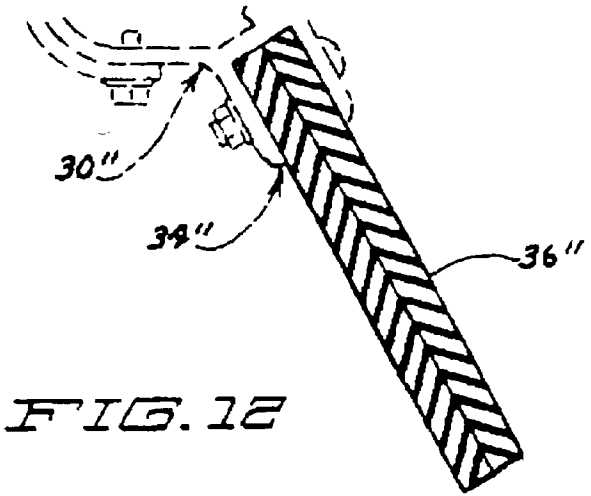
FIG. 12 is a partial side elevation of an alternate plow blade having an alternate rubber scraper.

Referring now also to FIG. 12, a further embodiment of the rubber scraper 36" is shown. In this embodiment, the rubber scraper 36" is made up of two separate sheets of skirtboard rubber that are secured together side by side within the channel 34" of the mold board 32".

Figure 13:
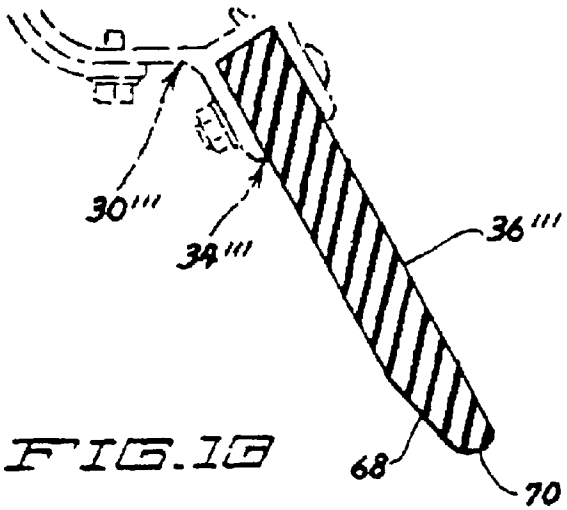
FIG. 13 is a further partial side elevation of an alternate plow blade showing a further alternate rubber scraper.

Referring now also to FIG. 13, a further alternate embodiment of the rubber scraper 36'" is shown in which the backside of the rubber scraper 36'" includes a slight bevel 68 or chamfer at the lower end 70 of the rubber scraper 36'".

Referring now again specifically to FIGS. 2 and 3, the plow blade 30 may be moved from a working orientation similar to that shown in FIG. 1 to a non-working transit orientation or position shown in FIG. 3 by raising one end of the plow blade 30 to the upper end 52 of the mounting upright, swinging the bottom 60 of the plow blade outward and away from the mounting upright 20 to permit the retention member 38 to slide over the catch structure 50 and be lowered into the attachment member 51 where it can be retained as shown in FIG. 3. After this has been done at one end, the same process can be followed to lift the opposite end of the plow blade 30 off of the mounting upright 20 so that the retention member 38 can be placed in the attachment member 51 in a manner similar to that shown in FIG. 3. Once both retention members 38 are retained within the attachment members 51 at the upper ends 52 of each of the mounting uprights 20, the plow blade 30 is in a non-working, transit orientation in which the plow blade 30 is not in contact with the ground and the vehicle may be used for purposes other than moving accumulated snow or other materials.

It is just as easy for a single individual to lower the plow blade 30 into a working orientation when it is in a non-working transit orientation. To lower the plow blade 30 into a working orientation, the individual can lift the retention member 38 out of the attachment member 51, swing the bottom 60 of the plow blade outward so as to generally pivot it away from the mounting upright 20, then lower the retention member 38 over the upper end 52 of the mounting upright 20 and allow the retention member to slide down the mounting upright 20 until the lower extremity of that end of the plow blade 30 comes into contact with the ground 56. Once the first end is in contact with the ground, the user can lift the opposite end in a similar manner, swinging the bottom 60 of the plow blade 30 outwardly so as to pivot the bottom 60 of the plow blade 30 away from the mounting upright 20, so that the remaining retention member 38 can be first of all disengaged from the attachment member and then lowered over the upper end 52 of the mounting upright 20 until the lower extremity of the remaining end of the plow blade 30 comes into contact with the ground. At this point, the plow blade 30 will be in a working orientation in which it may be pushed by the mounting apparatus to gather and remove snow or other particulate matter on the surface of the ground 56.

When the plow blade 30 is lowered into the working orientation, it operates simply when the vehicle moves forward and the mounting uprights 20 push the plow blade 30 forward in a manner which will generally cause the resilient rubber scraper 36 to bend at its lowest extremities in the manner shown in FIG. 1. When the alternate mounting apparatus 14" is used to tilt one end of the plow blade 30" back, the mounting uprights 20" still push the blade 30" and the retention members 38" hold the blade 30" in place in front of the mounting apparatus 14".

Referring now to FIG. 4, occasionally, the plow blade 30' will encounter greater resistance either to a mass of snow or other relatively immovable object on one side or the other, causing one end of the plow blade 30' or the other end of the plow blade 30' to ride up on the mounting upright 20' most proximate that particular end of the plow blade 30', as shown in phantom in FIG. 4. Because the retaining members 38 have openings 75 which are significantly larger than the mounting uprights 20', the plow blade 30' can ride up on one end or the other until retention member 38' is stopped by the stop structure 50 at the upper end of the respective mounting upright 22'.

It will be appreciated that the retention members 38, 38' are designed and constructed to provide an opening 75 which is large enough to allow a person to lift one end of the plow blade 30, 30' up and disengage the retention member 38, 38' from the respective mounting upright with which it is engaged when it is in a working orientation at the same time, however, the opening 75 has been designed and constructed and secured to the mold board 32, 32' of the plow blade 30, 30' is a manner which will not allow the retention member 38, 38' to slide all the way to the upper end 52, 52' of the mounting upright 20, 20' without eventually striking the stop structure 50, which will prevent the plow blade 30, 30' from disengaging from the mounting uprights 20, 20' unless the bottom 60, 60' of the plow blade 30, 30' is pivoted away from the mounting uprights 20, 20'.

Figure 14:
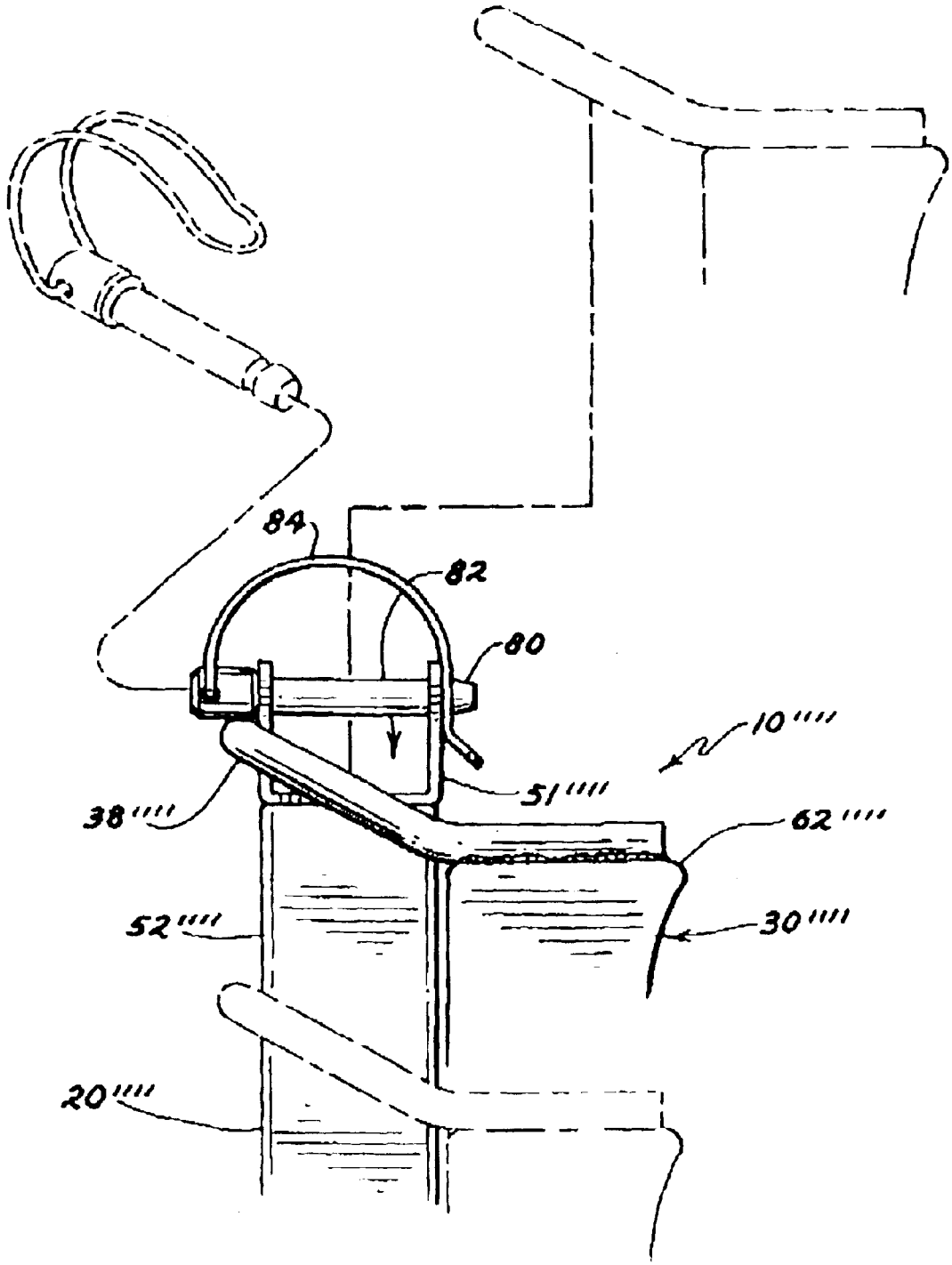
FIG. 14 is a side elevation of a portion of a further alternate embodiment of the present self-adjusting snow plow showing an alternate catch structure at the upper end of the mounting upright which also includes an alternate attachment member including a removable pin with which to secure the retention member within the attachment member.

Referring now also to FIG. 14, in a further alternate embodiment of the snow plow 10"", the retention members 38"" are stopped by a pin 80 which is secured within an alternate attachment member 51"". In this embodiment, the pin 80 must be removed in order to lift the retention member 38"" off of the upright 20"" and place the retention member 38"" within the attachment member 51"". Once the retention member is placed within the receiving opening 82 of the attachment member 51, the pin can be secured within openings (not shown) in the respective sides of the attachment member 51"" and a bale or spring wire 84 can be secured over an end of the pin 80 to secure the pin 80. Although not shown, a spring loaded ball bearing pin (not shown) can also be used in such an attachment member 51"".

Figure 15:
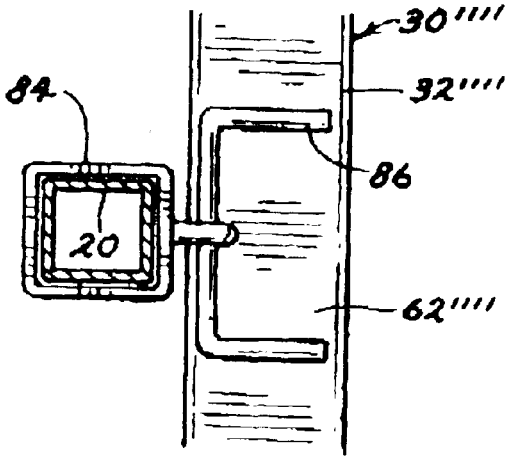
FIGS. 15 and 16 are top elevation views of alternate retention members.
Figure 16:
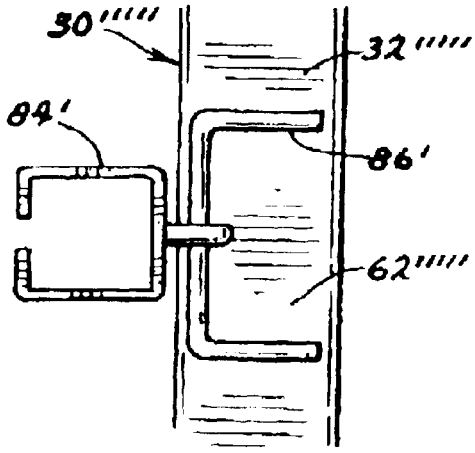
Figure 17:
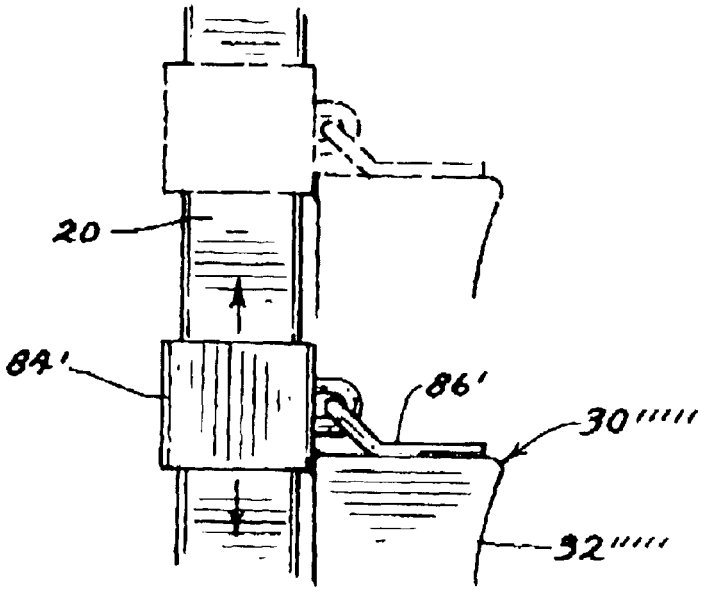
FIG. 17 is a side elevation of the alternate retention member shown in FIG. 15.

Referring now also to FIGS. 15–17, retaining members 84, 84' are shown which differ significantly from the retention members 38, 38', 38", 38'" and 38"". These retaining members 84 at least partially encircle the mounting uprights 20. As seen in FIG. 15, the retaining member 84 completely encircles the mounting upright 20 and is pivotally interconnected with the alternate mold board 32"" by a securing loop 86, which is welded to the top of the mold board 32"". In FIG. 16, a similar retaining member 84' is shown in which the retaining member 84' only partially encircles the mounting upright 20.

Figure 18:
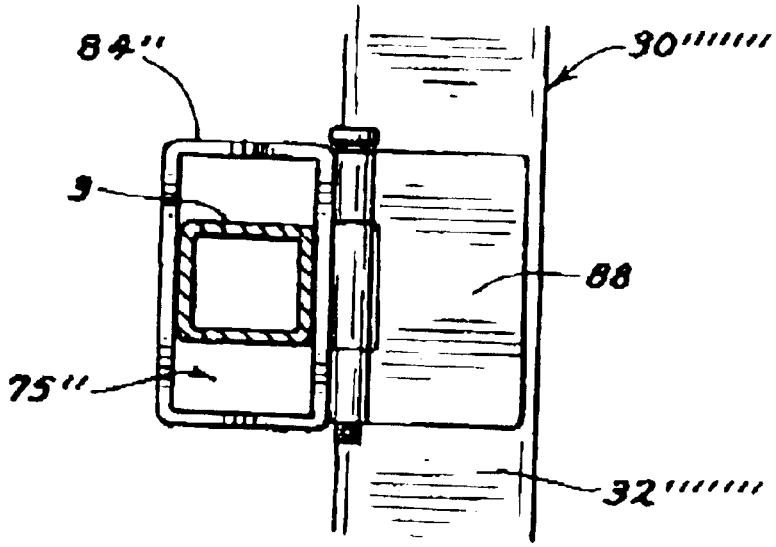
FIG. 18 is a top elevation of a further alternate retention member, which is pivotally secured to the alternate plow blade.
Figure 19:
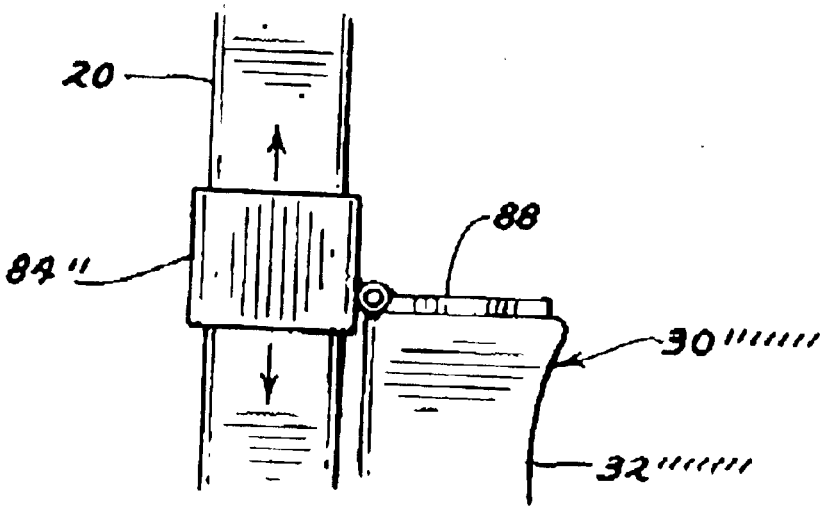
FIG. 19 is a side elevation of the alternate retention member shown in FIG. 18.

Referring now also to FIGS. 18 and 19, a further retaining member 84" is shown, which has a larger opening 75", thereby giving the mounting upright 20 greater latitude when moving side to side within the opening 75". This retaining member 84" is pivotally attached to a securing plate 88 which is welded to the alternate mold board 32""". It will be appreciated that the retaining member 84" may also have an incomplete side similar to that shown in FIG. 16 for retaining member 84'.

Figure 20:
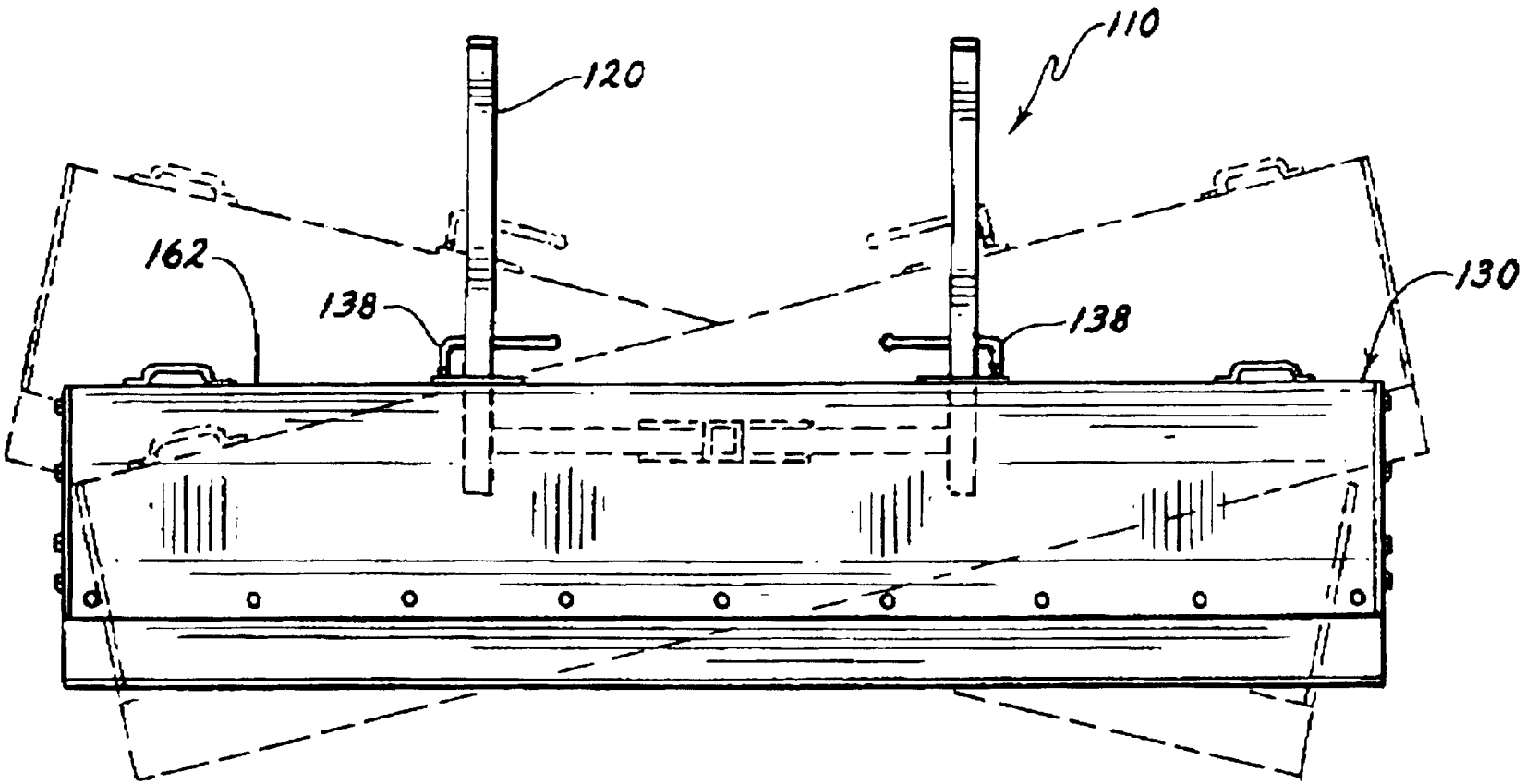
FIG. 20 is a front elevation of an alternate self-adjusting snow plow; similar to that shown in FIG. 4 where the plow blade is shown in a working orientation and is shown in phantom in further working orientations when one end or the other is raised with respect to the mounting uprights, but the plow includes alternate first and second retention members, each of which just partially encircles one of the respective mounting uprights.
Figure 21:
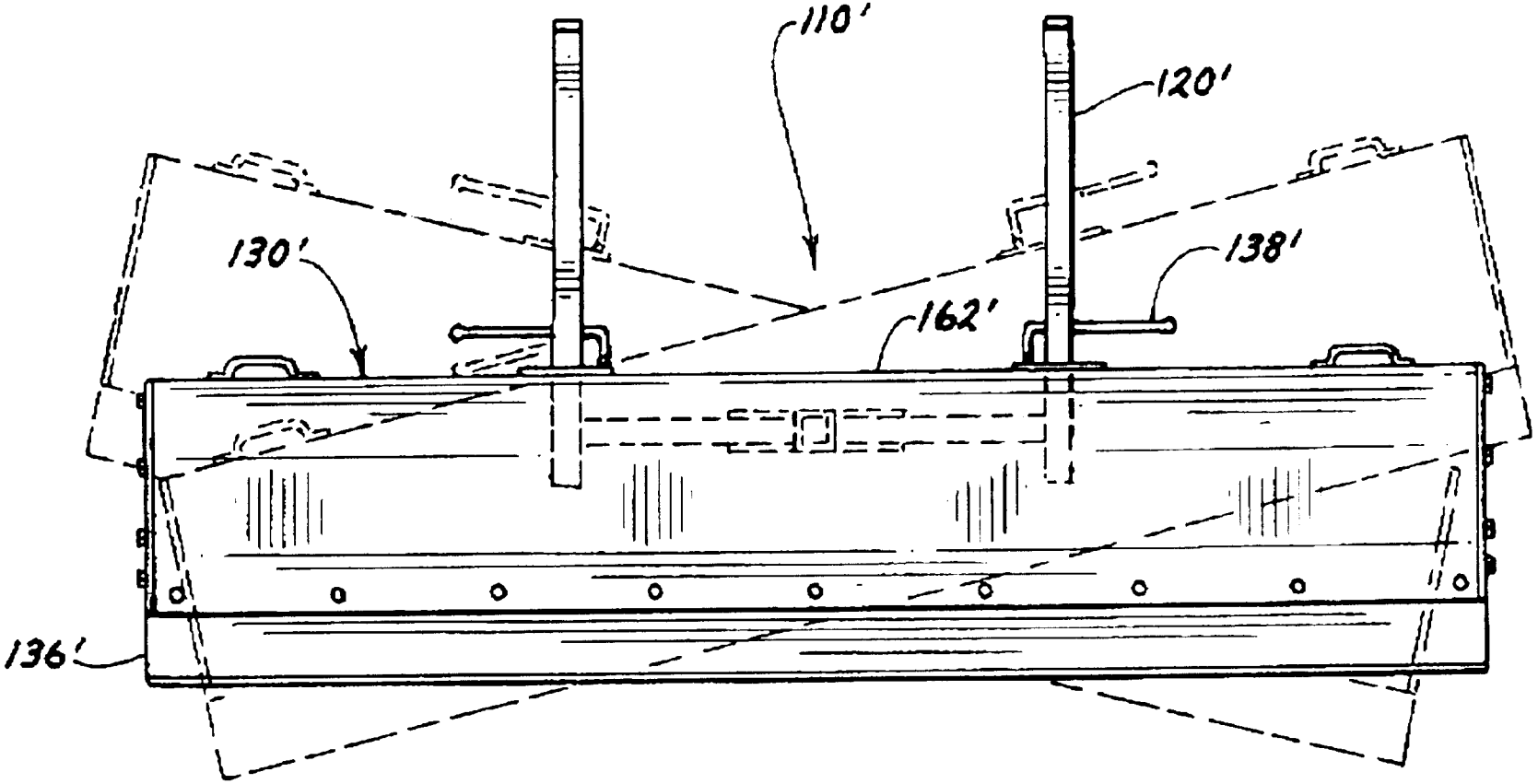
FIG. 21 is a front elevation of an alternate self-adjusting snow plow; similar to that shown in FIG. 4 where the plow blade is shown in a working orientation and is shown in phantom in further working orientations when one end or the other is raised with respect to the mounting uprights, but the plow includes further alternate first and second retention members, each of which just partially encircles one of the respective mounting uprights.
Figure 22:
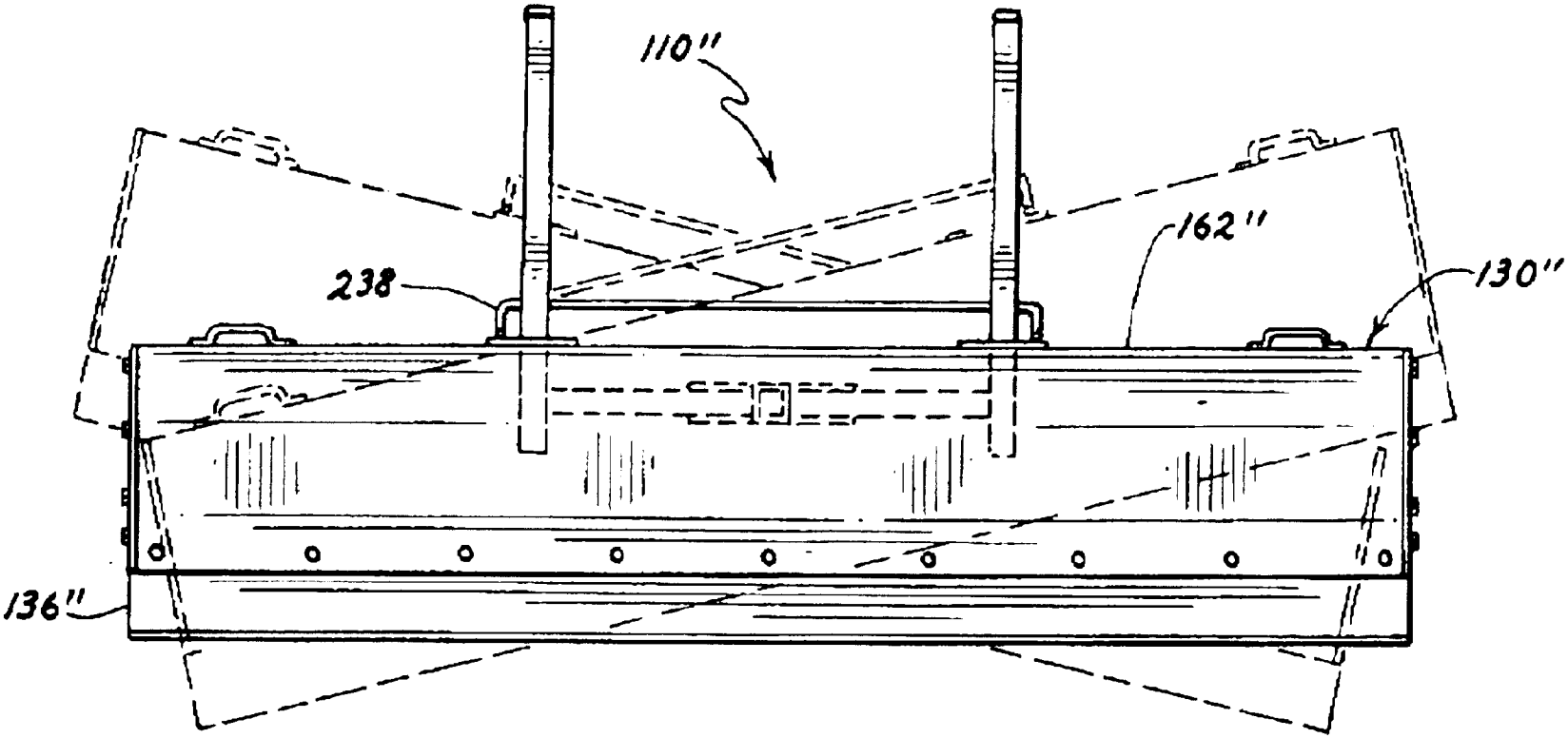
FIG. 22 is a front elevation of an alternate self-adjusting snow plow; similar to that shown in FIG. 4 where the plow blade is shown in a working orientation and is shown in phantom in further working orientations when one end or the other is raised with respect to the mounting uprights, but the plow only includes a single retention member which encircles both of the mounting uprights.
Figure 23:
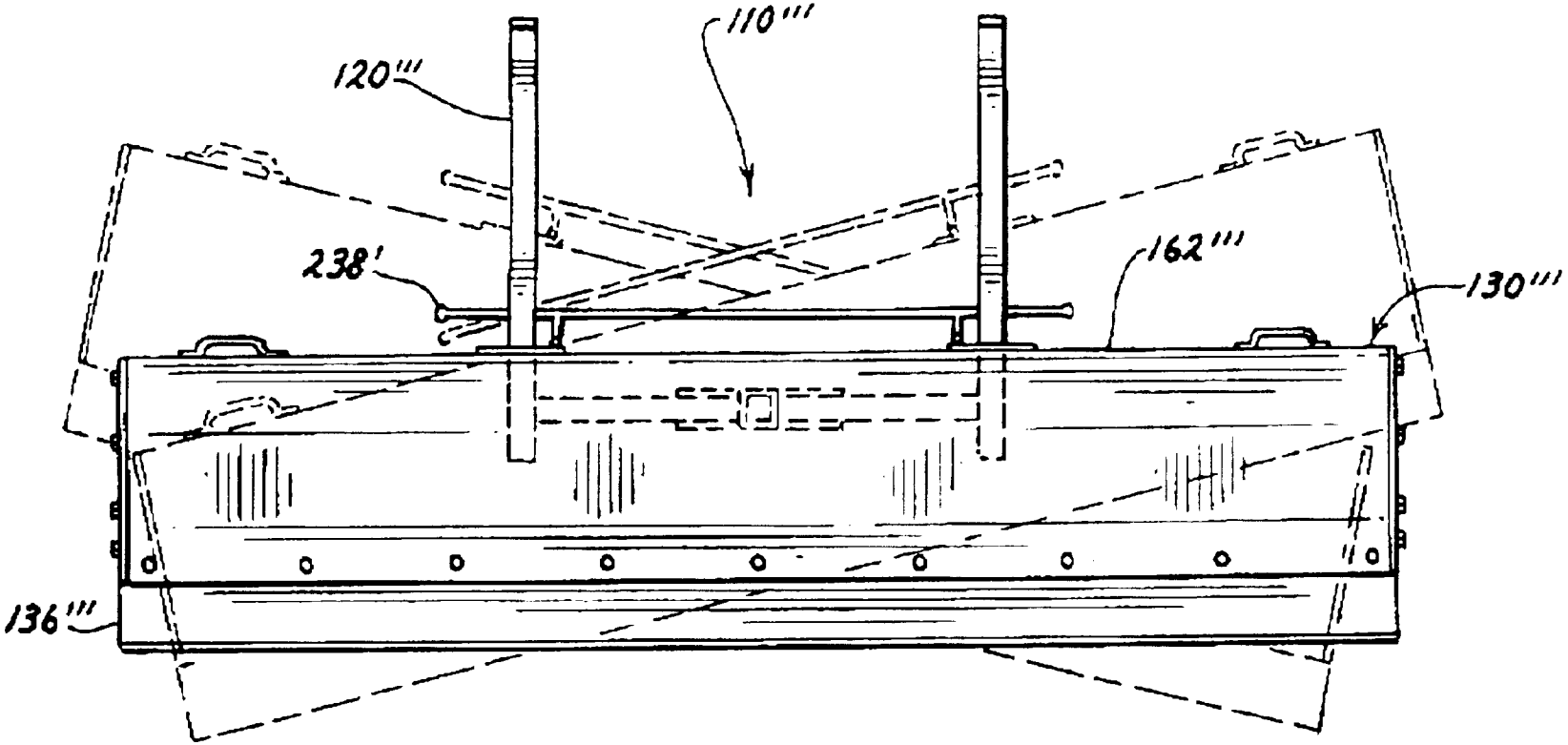
FIG. 23 is a front elevation of an alternate self-adjusting snow plow; similar to that shown in FIGS. 4 and 22 where the plow blade is shown in a working orientation and is shown in phantom in further working orientations when one end or the other is raised with respect to the mounting uprights, but the plow includes an alternate retention member, which just partially encircles each of the mounting uprights.

Referring now also to FIG. 20, an alternate embodiment of the snow plow 110 is shown having alternate retention members 138 which only partially encircle the mounting uprights 120 when the plow blade 130 is in a working orientation as shown. Referring now also to FIG. 21, a further embodiment to the snow plow 110' is shown having further alternate embodiments of the retention members 138', extending in an opposite direction as compared to that shown in FIG. 20, but once again only partially encircling the mounting uprights 120' when the plow blade 130' is in a working orientation as shown. Referring now also to FIG. 22, a further alternate embodiment of the plow blade 110" is shown in which a single retention member 238 is attached to the plow blade 130". The retention member 238' is shown in a working orientation and encircles each of the respective mounting uprights 120". Referring now also to FIG. 23, a further alternate embodiment of the plow blade 110'" is shown in which a single retention member 238' is attached to the plow blade 130'". The retention member 238' is shown in a working orientation and only partially encircles each of the respective mounting uprights 120'". In each of the aforementioned alternate snow plow embodiments, the plow blade may be disengaged from the respective mounting uprights one upright at a time or, as is also the case with each of the other aforementioned embodiments, the plow blades may be disengaged from the mounting uprights at the same time if both ends of the plow blade are lifted and disengaged at the same time.

Referring now also to FIG. 22, a further alternate embodiment of the snow plow 110" is shown having a single retention member 238 which encircles both of the mounting uprights 120" when the plow blade 130" is in a working orientation as shown.

In preferred embodiments, the mold board 32 of the plow blade 30 is a hollow extruded aluminum structure. In the most preferred embodiments, the aluminum surface will be clear anodized aluminum which is particularly attractive for consumers. Although the mold board can be extruded into two pieces which are subsequently assembled, the preferred embodiment is a one-piece extrusion which saves both on cost for aluminum and on cost for assembling the mold board. In preferred embodiments, the plow blade will weigh less than about 150 pounds, preferably about 110 pounds. The entire snow plow 10 including the mounting apparatus will preferably weight about 250 pounds, more preferably about 225 pounds.

When force is applied to the rubber scraper 36 of the present invention, the bottom of the rubber scraper 36 will bend backwards as shown in FIG. 1 and in FIG. 9 in reference to the alternate embodiment 30'. The rubber scraper 36 will generally bend at a generalized pivot point 81' which is located just below the edge of the channel within the mold board 32. In softer rubbers having a durometer of 40 or 50, the rubber scraper 36 tends to bend more. For that reason, harder rubbers having a durometer of at least 60, perhaps as much as 70 or 80, are preferred.

When installing the mounting apparatus, it is easiest to install the mounting uprights 20 in a perfectly vertical position as this is easiest to corroborate if a carpenter's level is available for use during the installation. It is possible, however, to tip the mounting uprights either forward or backward a small amount. When the uprights are tipped backward, the plow blade tends to rise somewhat more easily when it comes into contact with moveable objects, including accumulated snow on the ground. When the uprights are tipped slightly forward, this tends to put pressure on the rubber scraper 36 and it is believed that the plow blade 30 will not rise up on the mounting uprights 20 quite as easily as it will when the mounting uprights are perfectly upright. In certain embodiments, however, it may be desirable to tilt the uprights forward about two and one-half degrees from vertical. This will allow the rubber scraper to flex to a higher degree and appears to have a shock dampening effect during snow removal. Also, because the mounting uprights are tilted forward, it has an added effect of keeping the blade down when it is in use. In certain situations, this is most desirable as a user may be able to obtain superior results when the blade rises somewhat less readily or when the scraper comes under a lower degree of force. In this regard, it is also noted that the rubber scraper needs to extend outward in front of the mold board. It is believed that if the rubber scraper were straight up and down, the blade would lift up too easily and the snow would squirt under the blade 30 and result in poor snow removal. It is also noted that the rubber end caps will tend to bow outwardly even as great as 90 degrees to the direction of the movement of the plow. This is desirable as it allows the blade to catch more snow when moving it. It will be appreciated that the use of the word rubber in the present invention is used to refer to hardened rubber products which are commercially available and which include SBR, IIR, neoprene and the like.

An alternative embodiment of the present invention, shown in FIG. 6, in which the angle of the plow blade 30" can be varied in relation to its direction of travel. This embodiment is a pivoting snow plow 79 and allows the user to discharge snow on either side of the plow vehicle 18. In this embodiment of the invention, the connection of the hitch tongue 24" to the plow blade 30" is facilitated through the use of a pivot plate 42. The pivot plate 42 provides the point of attachment for a forward mounted mount bolt 53 which fastens the interconnecting member 22" to the hitch tongue 24" while allowing the plow blade 30" to pivot around it.

Additionally, the pivot plate 42 is equipped with a plurality of alternate locking holes 78 which, when used in conjunction with the locking pin 21, are used to lock the pivoting plow 79 into positions that push snow straight ahead, as shown in FIG. 6, or to the left or the right as shown in phantom in FIG. 6. This allows the user to employ this embodiment of the present invention in a plurality of orientations. The first of these is to lock the pivoting plow 79 in the position in which the plow blade 30" is square in relation to the line of travel. Conversely, to employ the side discharge function, the user simply locks the pin 21 in the desired alternate locking holes 78 to discharge the snow on the desired side of the plow vehicle 18 (not shown).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described herein, the details may be changed without departing from the intended scope of the invention, which is defined by the attached claims.

What is claimed is:

1. A self-adjusting snow plow for attachment to a vehicle in such a manner to permit the snow plow to make position adjustments when, during use when the vehicle is in motion, a portion of the snow plow comes into contact with a mass of snow or other objects on the ground, upon which the vehicle travels when in motion, that are relatively immoveable; the self-adjusting snow plow comprising:

a mounting apparatus for attachment to the vehicle, the mounting apparatus having first and second mounting uprights;

a plow blade having first and second ends, a top, a bottom, first and second retention members and a rubber scraper; each of the retention members being constructed and arranged to at least partially encircle one of the respective mounting uprights when the plow blade is engaged with the mounting apparatus in a working orientation where the plow blade is in contact with the ground or objects on the ground; wherein each of the respective retention members is slidably engaged with one of the respective mounting uprights when each of the respective retention members at least partially encircles one of the respective mounting uprights; the plow blade being adjustable from one position to another when the plow blade comes into contact with a mass of snow or other objects on the ground that are relatively immoveable and one or the other of the first and second retention members slides upwardly along the respective mounting upright with which the respective retention member is slidably engaged; the respective retention members allowing one of the respective ends of the plow blade to slide upward relative to the mounting upright most proximate to that end of the plow blade while the other end of the plow blade remains generally in the same position relative to the mounting upright proximate that end of the plow blade; the retention members permitting the bottom of the plow blade to pivot away from the respective mounting uprights when the plow blade is engaged with the mounting apparatus in a working orientation and the vehicle is in motion in a direction rearward of the plow blade.

2. The self-adjusting snow plow of claim 1, wherein the plow blade includes a mold board within which the rubber scraper is secured and the rubber scraper is a resilient elastomeric member having a resting orientation in which the rubber scraper extends downwardly and away from the bottom of the mold board at an angle extending forward of a plane along a main surface of the plow blade.

3. The self-adjusting snow plow of claim 2, wherein the plow blade has first and second end caps secured to each of the respective first and second ends of the mold board, each of the respective end caps extending away from and below the bottom of the mold board so as to generally extend below the mold board and substantially prevent the mold board from coming into contact with the ground.

4. The self-adjusting snow plow of claim 2, wherein the plow blade includes a mold board within which the rubber scraper is secured and the rubber scraper extends away from the mold board at least about 3.5 inches.

5. The self-adjusting snow plow of claim 1, the mounting uprights having upper ends; wherein the plow blade is disengageable from the mounting apparatus when the plow blade is moved upward so as to raise the respective retention members over respective upper ends of each of the respective mounting uprights.

6. The self-adjusting snow plow of claim 5, each of the mounting uprights having a catch structure at the upper ends of the mounting uprights that limit the slideable movement of the respective retention members along the mounting uprights at the respective upper ends of each of the respective mounting uprights.

7. The self-adjusting snow plow of claim 1, the mounting uprights having upper ends; wherein the mounting uprights have attachment members proximate the respective upper ends of the mounting uprights that provide a structure within which to secure respective retention members in order to secure the plow blade in a non-working transit orientation, wherein the retention members can be retained in the attachment members in order to retain the plow blade in the non-working transit orientation in which the plow blade is not in contact with the ground.

8. The self-adjusting snow plow of claim 1, wherein the mounting apparatus includes a hitch receiver attached to the vehicle, a hitch assembly including a hitch tongue, the hitch tongue being secured to the hitch receiver.

9. The self-adjusting snow plow of claim 8, wherein the hitch assembly includes the first and second mounting uprights, an interconnecting member securing the respective mounting uprights to one another, and a resilient rubber connecting member secured between the hitch tongue and the interconnecting member so as to permit the hitch assembly to bend under pressure at the resilient rubber connecting member.

10. The self-adjusting snow plow of claim 1, the mounting uprights having upper ends; wherein each of the respective retention members can be independently disengaged from the respective mounting upright, when the plow blade is in a working orientation, by lifting the plow blade, one end at a time, to separately disengage the respective retention member from the upper end of the respective mounting upright with which it is engaged, so that the plow blade is no longer in a working orientation.

11. The self-adjusting snow plow of claim 10, wherein each mounting upright includes a stop structure to limit the distance a retention member can slide upward on the upright and an attachment member to which the retention member can be attached when the plow blade is no longer in the working orientation.

12. The self-adjusting snow plow of claim 11, wherein the plow blade is in a non-working transit orientation when the respective retention members are secured in the respective attachment members.

13. A self-adjusting snow plow for attachment to a vehicle in such a manner to permit the snow plow to make position adjustments when, during use when the vehicle is in motion, a portion of the snow plow comes into contact with a mass of snow or other objects on the ground, upon which the vehicle travels when in motion, that are relatively immoveable; the self-adjusting snow plow comprising:

a mounting apparatus for attachment to the vehicle, the mounting apparatus having first and second mounting uprights, each of the mounting uprights having upper ends;

a plow blade having first and second ends, a top, a bottom, first and second retention members and a rubber scraper; each of the retention members being constructed and arranged to at least partially encircle one of the respective mounting uprights when the plow blade is engaged with the mounting apparatus in a working orientation where the plow blade is in contact with the ground or objects on the ground; wherein each of the respective retention members is slidably engaged with one of the respective mounting uprights when each of the respective retention members at least partially encircles one of the respective mounting uprights; the plow blade being adjustable from one position to another when the plow blade comes into contact with the mass of snow or other objects on the ground that are relatively immoveable and one or the other of the first and second retention members slides upwardly along the respective mounting upright with which the respective retention member is slidably engaged; the respective retention members allowing one of the respective ends of the plow blade to slide upward relative to the mounting upright most proximate to that end of the plow blade while the other end of the plow blade remains generally in the same position relative to the mounting upright proximate that end of the plow blade; the retention members permitting the bottom of the plow blade to pivot away from the respective mounting uprights when the plow blade is engaged with the mounting apparatus in a working orientation and the vehicle is in motion in a direction rearward of the plow blade; wherein each of the respective retention members can be independently disengaged from the respective mounting upright, when the plow blade is in a working orientation, by lifting the plow blade, one end at a time, to separately disengage the respective retention member from the upper end of the respective mounting upright with which it is engaged, so that the plow blade is no longer in a working orientation.

14. The self-adjusting snow plow of claim 13, wherein each mounting upright includes a stop structure to limit, the distance a retention member can slide upward on the upright and an attachment member to which the retention member can be attached when the plow blade is no longer in the working orientation.

15. The self-adjusting snow plow of claim 14, wherein the plow blade is in a non-working transit orientation when the respective retention members are secured in the respective attachment members.

16. The self-adjusting snow plow of claim 13, wherein the plow blade includes a mold board within which the rubber scraper is secured and the rubber scraper is a resilient elastomeric member having a resting orientation in which the rubber scraper extends downwardly and away from the bottom of the mold board at an angle extending forward of a plane along a main surface of the plow blade.

17. The self-adjusting snow plow of claim 16, wherein the plow blade has first and second end caps secured to each of the respective first and second ends of the mold board, each of the respective end caps extending away from and below the bottom of the mold board so as to generally extend below the mold board and substantially prevent the mold board from coming into contact with the ground.

18. The self-adjusting snow plow of claim 17, wherein the respective end caps are made of a resilient elastomeric material.

19. The self-adjusting snow plow of claim 16, wherein the plow blade includes a mold board within which the rubber scraper is secured and the rubber scraper extends away from the mold board at least about 3.5 inches.

20. The self-adjusting snow plow of claim 13, the mounting uprights having upper ends; wherein the plow blade is disengageable from the mounting apparatus when the plow blade is moved upward so as to raise the respective retention members over respective upper ends of each of the respective mounting uprights.

21. The self-adjusting snow plow of claim 20, each of the mounting uprights having a catch structure at the upper ends of the mounting uprights that limit the slideable movement of the respective retention members along the mounting uprights at the respective upper ends of each of the respective mounting uprights.

22. The self-adjusting snow plow of claim 13, the mounting uprights having upper ends; wherein the mounting uprights have attachment members proximate the respective upper ends of the mounting uprights that provide a structure within which to secure respective retention members in order to secure the plow blade in a non-working transit orientation, wherein the retention members can be retained in the attachment members in order to retain the plow blade in the non-working transit orientation in which the plow blade is not in contact with the ground.

23. The self-adjusting snow plow of claim 14, wherein the mounting apparatus includes a hitch receiver attached to the vehicle, a hitch assembly including a hitch tongue, the hitch tongue being secured to the hitch receiver.

24. The self-adjusting snow plow of claim 23, wherein the hitch assembly includes the first and second mounting uprights, an interconnecting member securing the respective mounting uprights to one another, and a resilient rubber connecting member secured between the hitch tongue and the interconnecting member so as to permit the hitch assembly to bend under pressure at the resilient rubber connecting member.

25. A self-adjusting snow plow for attachment to a vehicle in such a manner to permit the snow plow to make position adjustments when, during use when the vehicle is in motion, a portion of the snow plow comes into contact with a mass of snow or other objects on the ground, upon which the vehicle travels when in motion, that are relatively immoveable; the self-adjusting snow plow comprising:

a mounting apparatus for attachment to the vehicle, the mounting apparatus having first and second mounting uprights;

a plow blade having first and second ends, a top, a bottom, a retention member and a rubber scraper; the retention member being constructed and arranged to at least partially encircle both of the respective mounting uprights when the plow blade is engaged with the mounting apparatus in a working orientation where the plow blade is in contact with the ground or objects on the ground; wherein the respective retention member is slidably engaged with both of the respective mounting uprights when the retention member at least partially encircles the respective mounting uprights; the plow blade being adjustable from one position to another when the plow blade comes into contact with a mass of snow or other objects on the ground that are relatively immoveable and the retention member slides upwardly along the respective mounting uprights with which the retention member is slidably engaged; the respective retention member allowing one of the respective ends of the plow blade to slide upward relative to the mounting upright most proximate to that end of the plow blade while the other end of the plow blade remains generally in the same position relative to the mounting upright proximate that end of the plow blade; the retention member permitting the bottom of the plow blade to pivot away from the mounting uprights when the plow blade is engaged with the mounting apparatus in a working orientation and the vehicle is in motion in a direction rearward of the plow blade.

26. The self-adjusting snow plow of claim 25, wherein the plow blade includes a mold board within which the rubber scraper is secured and the rubber scraper is a resilient elastomeric member having a resting orientation in which the rubber scraper extends downwardly and away from the bottom of the mold board at an angle extending forward of a plane along a main surface of the plow blade.

27. The self-adjusting snow plow of claim 26, wherein the plow blade has first and second end caps secured to each of the respective first and second ends of the mold board, each of the respective end caps extending away from and below the bottom of the mold board so as to generally extend below the mold board and substantially prevent the mold board from coming into contact with the ground.

28. The self-adjusting snow plow of claim 27, wherein the respective end caps are made of a resilient elastomeric material.

29. The self-adjusting snow plow of claim 26, wherein the plow blade includes a mold board within which the rubber scraper is secured and the rubber scraper extends away from the mold board at least about 3.5 inches.

30. The self-adjusting snow plow of claim 25, the mounting uprights having upper ends; wherein the plow blade is disengageable from the mounting apparatus when the plow blade is moved upward so as to raise the retention member over respective upper ends of each of the respective mounting uprights.

31. The self-adjusting snow plow of claim 30, each of the mounting uprights having a catch structure at the upper ends of the mounting uprights that limit the slideable movement of the retention member along the mounting uprights at the respective upper ends of each of the respective mounting uprights.

32. The self-adjusting snow plow of claim 30, wherein the mounting uprights have attachment members proximate the respective upper ends of the mounting uprights that provide a structure within which to secure the retention member in order to secure the plow blade in a non-working transit orientation, wherein the retention member can be retained in the attachment members in order to retain the plow blade in the non-working transit orientation in which the plow blade is not in contact with the ground.

* * * * *